US005518130A

United States Patent [19]

Weyant, Jr.

[11] Patent Number: 5,518,130

[45] Date of Patent: May 21, 1996

[54] SAMPLE CONTAINER FOR USE IN A CENTRIFUGE INSTRUMENT

[75] Inventor: Oakley L. Weyant, Jr., Southbury, Conn.

[73] Assignee: E. I. Du Pont de Nemours and Company, Wilmington, Del.

[21] Appl. No.: 352,696

[22] Filed: Dec. 1, 1994

[51] Int. Cl.[6] ..... B65D 39/08

[52] U.S. Cl. ..... 215/357; 215/46; 215/356

[58] Field of Search ..... 215/357, 356, 215/354, 46, 45

[56] References Cited

U.S. PATENT DOCUMENTS 1,911,354 5/1933 De Long ..... 215/356

FOREIGN PATENT DOCUMENTS 2438892 2/1975 Germany ..... 215/356

12461 of 1886 United Kingdom ..... 215/357

OTHER PUBLICATIONS

DuPont Company Catalog, *Rotors, Tubes, Bottles, and Adapters for Sorvall Centrifuges,* cover and p. 7, Dec. 1, 1984 and Drawing No. 00624–4 and 00625–5.

*Primary Examiner*—Stephen J. Castellano

[57] ABSTRACT

A generally cylindrical, open topped, container for use in a centrifuge instrument has a seal ring disposed in a circumferentially extending groove provided on the interior surface of the container. At least one generally axially extending channel is formed in the interior surface of the container with a first end of the channel communicating with the groove. The intersection of the channel with the groove exposes a portion of the seal ring whereby an implement, such as the tingemail of an operator, may engage the seal ring, thereby to facilitate the removal of the seal ring from the groove.

12 Claims, 3 Drawing Sheets

FIG.2
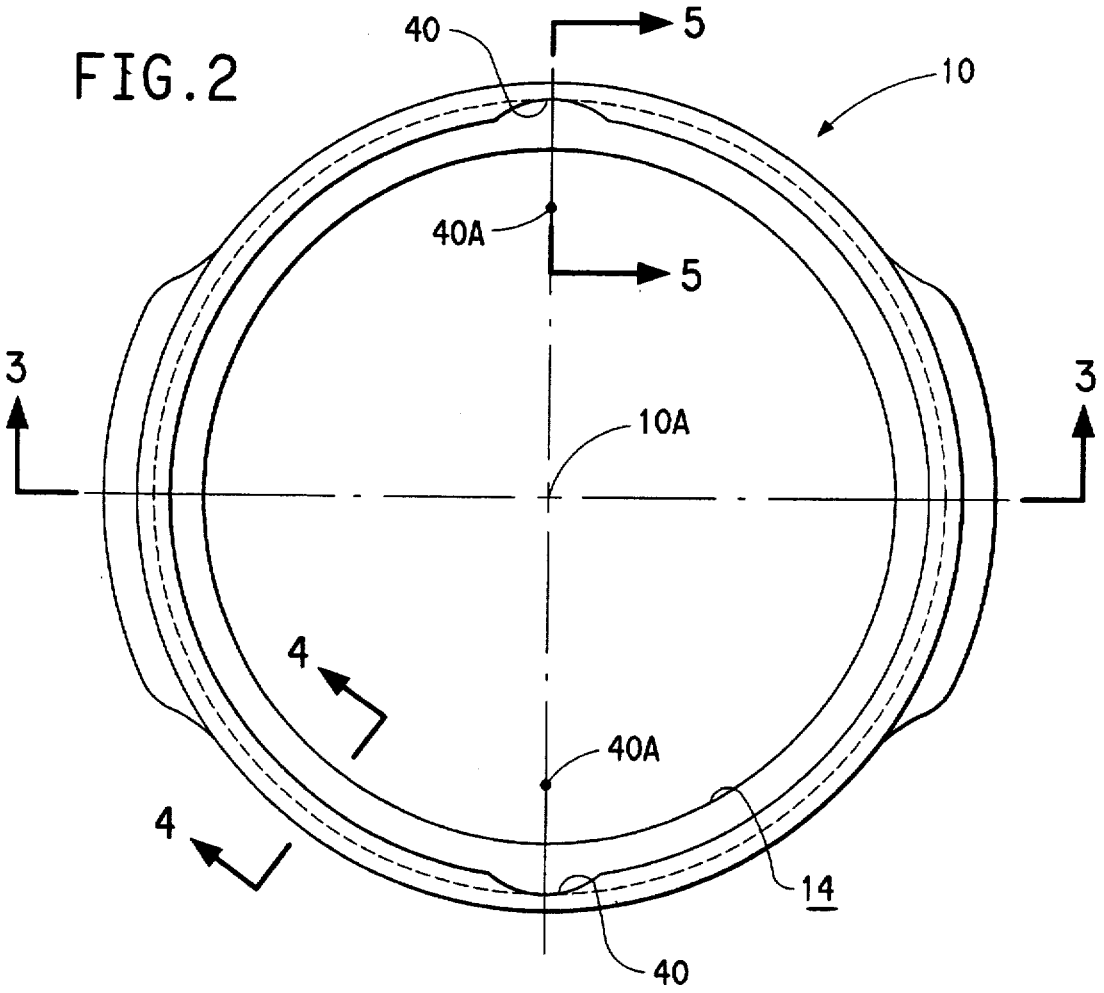
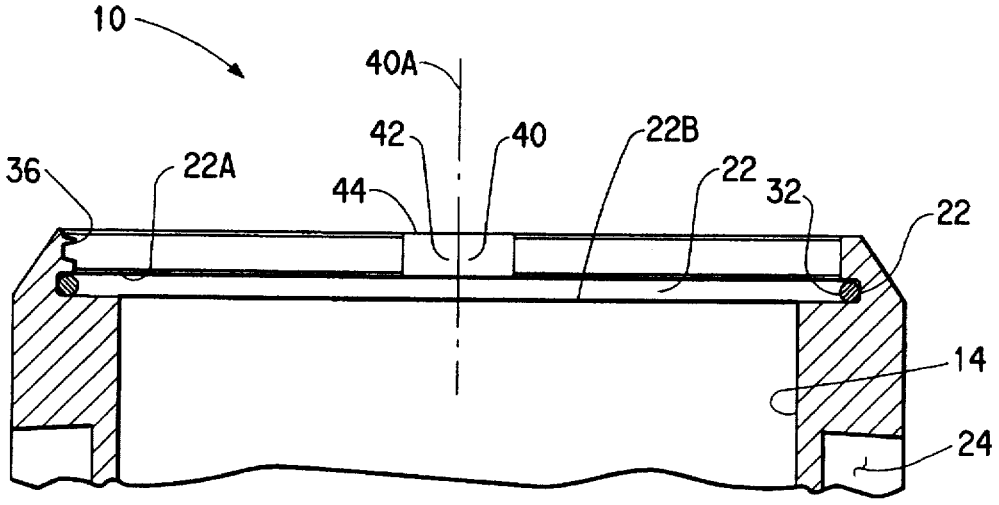
FIG.3

SAMPLE CONTAINER FOR USE IN A CENTRIFUGE INSTRUMENT

BACKGROUND OF THE INVENTION

1. Field of the Invention

The present invention relates to a sample container for use in a centrifuge instrument and, in particular, to a container wherein the seal ring of the container is easily removable.

2. Description of the Prior Art

A centrifuge rotor is a relatively massive member in which a liquid sample is exposed to a centrifugal force field. The liquid sample is carried in a container, such as a bucket (for use in swinging bucket centrifuge rotor) or a bottle (for use in a vertical or fixed angle centrifuge rotor). Often the sample may contain biologically hazardous material whose escape from the container may present a health or safety threat to the user of the centrifuge instrument.

In order to prevent leakage or aerosoling of the liquid from the container o-ring members are typically employed to insure sealed engagement between the body of the container and its cover. The o-ring seal is usually disposed in a circumferentially extending groove located on the interior surface of the container. The o-ring seal and the groove in which it is received require frequent cleaning and lubrication. Cleaning is necessary to prevent the buildup of foreign matter (such as dirt or chemical deposits) which may define a leakage passage around the seal. Lubrication is needed to maintain elasticity and flexibility of the material of the ring, and thus maintain its ability to form a seal. In addition, lubrication provides lubricity for facilitating assembly of the container and its associated cover.

The closed configuration of the groove and/or its location within the container make it difficult to access and to remove the ring tier cleaning or lubrication. It is typically necessary to use an implement, such as a pick or a forceps, to pry or to grasp the ring to extricate it from the groove. However, the use of such an implement carries with it the risk that the surface of the o-ring may be scored or otherwise damaged, leading to the possibility of seal leakage.

In view of the foregoing it is believed to be advantageous to provide a container for holding a sample within a centrifuge instrument that is configured in a manner that facilitates accessibility and removability of an o-ring seal from its associated groove.

SUMMARY OF THE INVENTION

The present invention is directed to a container for holding a liquid sample in a centrifuge instrument, such as a bucket for a swinging bucket centrifuge rotor. The container is a generally cylindrical body with an open top, a closed bottom and an interior surface. The container has a longitudinal axis extending therethrough. A circumferentially extending groove is disposed on the interior surface of the container at a location axially spaced from the open top. The groove has a seal ring disposed therein.

In accordance with the present invention, at least one generally axially extending channel is foraged in the interior surface of the body with a first end of the channel communicating with communicating with the groove. The intersection of the channel with the groove exposes a portion of the seal ring whereby an implement, one which would not damage either the seal ring or the groove, may engage the seal ring, thereby to facilitate the removal of the seal ring from the groove. The second end of the channel may communicate with the open top of the container, if desired. In addition, threads may be provided on the interior surface of the container, axially above the groove.

BRIEF DESCRIPTION OF THE DRAWINGS

The present invention will be fully understood from following detailed description thereof, taken in connection with the accompanying drawings, which form apart of this application, and in which:

FIG. 2 is a plan view of the container of FIG. 1;

FIG. 3 is partial elevational view of the container of FIG. 2, taken in section along section lines 3—3 therein.

DETAILED DESCRIPTION OF THE INVENTION

Figure 1:
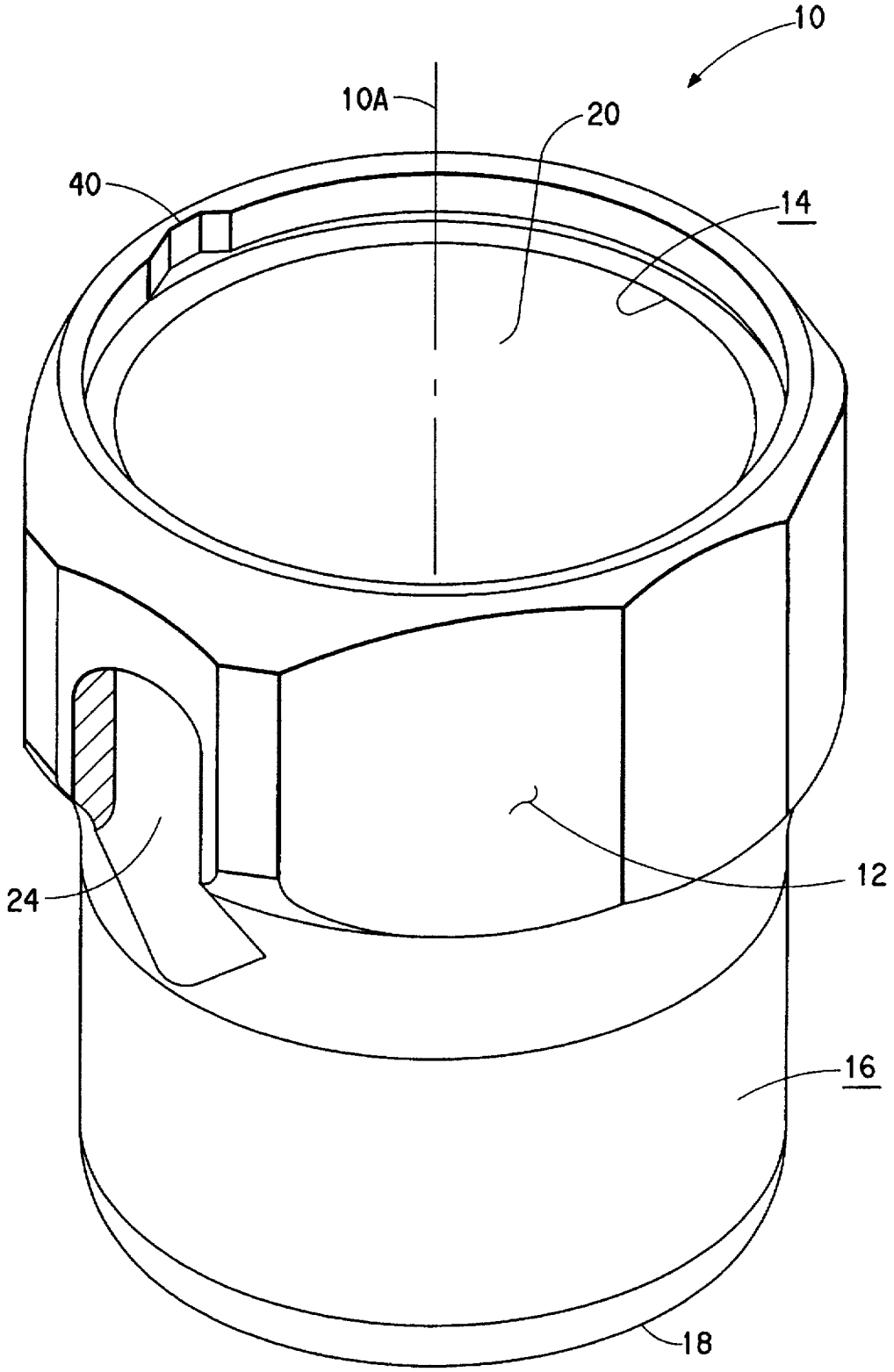
FIG. 1 is a perspective view of a container in accordance with the present invention.

Throughout the following detailed description, similar reference characters refer to similar elements in all Figures of the drawings.

Figure 4:
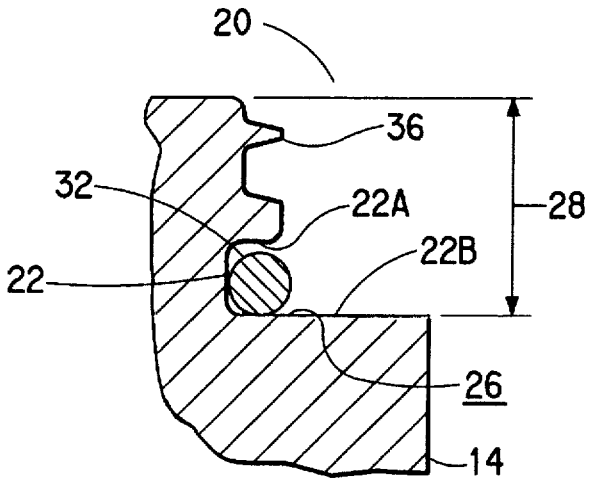
FIGS. 4 and 5 are detailed sectional views of the container of FIG. 1, as taken along section lines 4—4 and 5—5 of FIG. 2.
Figure 5:
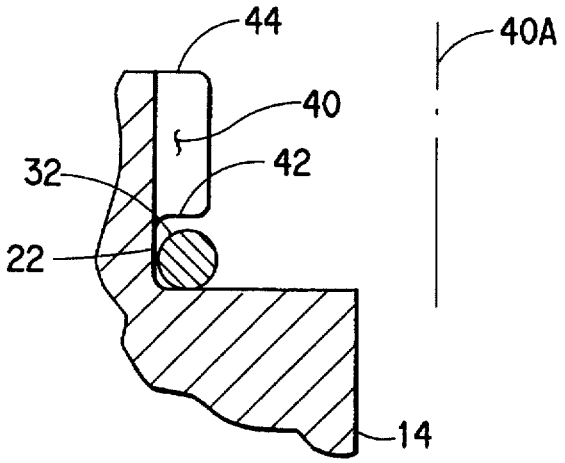

A container for holding a liquid sample in a centrifuge instrument is generally indicated by the reference character 10. The container 10 includes a generally cylindrical body portion 12 having an interior surface 14 and an exterior surface 16. The container 10 has a closed bottom 18 (FIG. 1) and an open top 20. The longitudinal axis of the container 10 is indicated by the reference character 10A. As may be perhaps best seen in FIG. 4 a groove 22 is defined by upper and lower lands 22A, 22B, respectively, formed into the interior surface 14 of the container 10. Except as will be noted hereinafter, the lands 22A, 22B are circumferentially continuous. The lower land 22B may, as illustrated, extend radially inwardly toward the axis 10A a greater extent than does the land 22A, thus defining a seating surface 26. The groove 22 is spaced a predetermined axial distance 28 from the open top 20 of the container 10. The groove 22 has a seal ring 32 therein.

The container as disclosed herein may be employed in any of a variety of circumstances, for example, as a bucket usable in a swinging bucket centrifuge rotor, or as a bottle insertable into a cavity in a fixed or vertical angle centrifuge rotor. To facilitate the use of the container 10 in the former circumstance the exterior surface 16 of the container 10 has a trunnion mounting arrangement 24 disposed thereon. Although the trunnion mounting arrangement 24 is illustrated in the form of generally axially extending slots it lies within the contemplation of the invention to provide mounting 24 in the form of trunnion pins.

Whether configured for use as a bucket or as a bottle the container 10 is provided with a cover (not shown). When mounted to the container, the lip of the cover seats against the seating surface 26 on the lower land 22B. The cover may be attached to the container 10 by either a friction fit or by a threaded interconnection. In the latter instance the body 12 of the container is provided with threads 36 on either the interior surface 14 (as illustrated) or on the exterior surface 16. When provided on the interior, the threads 36 are disposed in the region 28 between the open top 20 and the groove 22.

In accordance with the present invention at least one channel 40 is formed in the interior surface 14 of the container 10. In the preferred case the axis 40A of the channel 40 extends generally parallel to the axis 10A of the container 10. However, it should be understood that the axis 40A may be inclined with respect to the axis 10A. The lower end 42 of the channel 40 interrupts the upper land 22A whereby the channel 40 communicates with the groove 22. Preferably, the second end 44 of the channel 40 communicates with the open top 20 of the container 10. The channel 40 interrupts the threads 36, if they are provided. The channel 40 is conveniently formed on the interior surface 14 of the container 10 by milling, although any suitable expedient may be used. Additional channels 40 may be circumferentially disposed on the interior surface 14, if desired. Preferably, such additional channels would be uniformly spaced about the axis 10A.

The intersection of the channel 40 with the groove 22 exposes a portion of the seal ring 24 disposed within the groove. Thus, an implement may be inserted between the seal ring and the interior surface 14 of the container 10 to engage the seal ring 24 and, thus, facilitate its removal from the groove 22. The implement should such that its use in removing the seal ring 32 will not cause damage to either the ring 32 or to the groove 22. If the circumferential dimension of the channel 22 is sufficiently sized it is possible that the tingemail of an operator may serve as the removal implement.

Those skilled in the art, having the benefit of the teachings of the present invention may impart numerous modifications thereto. Such modifications are to be construed as lying within the scope of the present invention, as defined by the appended claims.

What is claimed is:

1. In a container for holding a liquid sample in a centrifuge instrument, the container having a generally cylindrical body with an open top, a closed bottom and an interior surface, the body having a longitudinal axis extending therethrough and a groove for a seal ring extending circumferentially about the interior surface, the groove being spaced a predetermined axial distance from the open top, the groove being defined by an upper and a lower land, the lower land being spaced farther from the open top of the container than is the upper land, the lower land extending radially inwardly toward the axis of the container for a greater extent than does the upper land thereby to define a seating surface for a seal ring, wherein the improvement comprises:

at least one channel formed in the interior surface of the body, a first end of the channel interrupting the upper land and communicating with the groove and thereby with a portion of the lower land defining the same.

2. The container of claim 1 wherein a second end of the channel communicates with the open top.

3. The container of claim 1 wherein the body has an exterior surface thereon, the exterior surface having a trunnion mounting arrangement thereon.

4. The container of claim 3 wherein the interior surface of the body between the groove and the open top is threaded, the channel extending through the threads.

5. The container of claim 2 wherein the interior surface of the body between the groove and the open top is threaded, the channel extending through the threads.

6. The container of claim 1 wherein the interior surface of the body between the groove and the open top is threaded, the channel extending through the threads.

7. In a container for holding a liquid sample in a centrifuge instrument, the container having a generally cylindrical body with an open top, a closed bottom and an interior surface, the body having a longitudinal axis extending therethrough and a groove extending circumferentially about the interior surface, the groove being spaced a predetermined axial distance from the open top of the container, the groove being defined by an upper and a lower land, the lower land being spaced farther from the open top of the container than is the upper land, the lower land and extending radially inwardly toward the axis of the container for a greater extent than does the upper land thereby to define a seating surface for a seal ring, the groove having a seal ring disposed therein, the seal ring being received on the seating surface defined by the lower land, wherein the improvement comprises:

at least one channel formed in the interior surface of the body, a first end of the channel interrupting the upper land and communicating with the groove to expose a portion of the seal ring received on the seating surface defined by the lower land whereby an implement may engage the seal ring to facilitate its removal from the groove.

8. The container of claim 7 wherein a second end of the channel communicates with the open top.

9. The container of claim 7 wherein the body has an exterior surface thereon, the exterior surface having a trunnion mounting arrangement thereon.

10. The container of claim 9 wherein the interior surface of the body between the groove and the open top is threaded, the channel extending through the threads.

11. The container of claim 8 wherein the interior surface of the body between the groove and the open top is threaded, the channel extending through the threads.

12. The container of claim 7 wherein the interior surface of the body between the groove and the open top is threaded, the channel extending through the threads.

* * * * *